United States Patent [19]

Chaumel

[11] Patent Number: 4,594,783

[45] Date of Patent: Jun. 17, 1986

[54] PROCESS FOR THE STANDARDIZATION OF PRIMARY MODELS USED IN THE FABRICATION OF SHOES

[75] Inventor: Francisco M. Chaumel, Elda-Alicante, Spain

[73] Assignee: Procedimientos Industriales Technologicos para la Fabricacion de Maquinaria y Afines del Calzada, S.A. (PIT MAC, S.A.), Spain

[21] Appl. No.: 580,141

[22] Filed: Feb. 14, 1984

[30] Foreign Application Priority Data

Feb. 17, 1983 [ES] Spain ..... 519.867

[51] Int. Cl.[4] ..... A43D 1/00

[52] U.S. Cl. ..... 33/6; 33/4

[58] Field of Search ..... 33/3 R, 4, 5, 6, 562; 12/146 L, 146 R, 142 R, 133 R

[56] References Cited

U.S. PATENT DOCUMENTS 2,394,780 2/1946 Ipedale ..... 12/146 L
2,514,518 7/1950 Ryan ..... 12/146 L
2,716,294 8/1955 Schwartz et al. ..... 12/133 R X
3,321,833 5/1967 Mann ..... 33/6
4,412,364 11/1983 Mateo ..... 12/146 L

*Primary Examiner*—Harry N. Haroian
*Attorney, Agent, or Firm*—Laff, Whitesel, Conte & Saret

[57] ABSTRACT

A process enabling original primary models to be prepared for fabricating shoes. The process begins with forming a longitudinal profile of a last relative, to a theoretical ground line. The ground line length of said last corresponds to the actual length of the longitudinal profile. Then the profile is divided into three equal parts, thus forming two posterior thirds and one anterior third. A basic longitudinal support is established for the part of the foot which in the two posterior thirds, the support especially affecting the tarsus and metatarsus zone. A basic support is provided for the plantar or flexion part of the foot in the front third. Templates are formed and assemble corresponding to the supports established by the process. Then any voids are filled between the templates in order to form the assembly into a solid basic primary model.

11 Claims, 39 Drawing Figures

Fig 6 bis

Fig 7 bis

Fig 8 bis

Fig 9 bis

Fig 10 bis

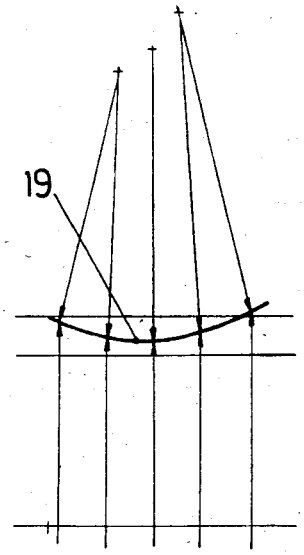
Fig 19
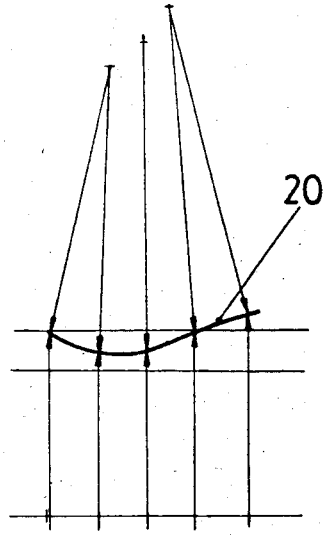
Fig 20
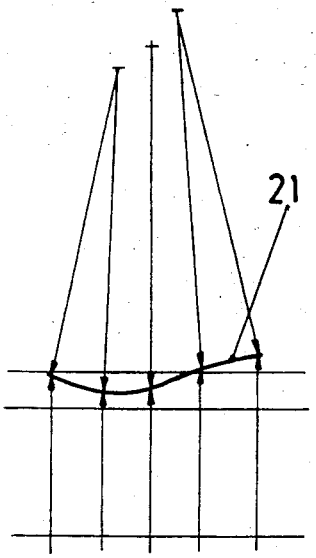
Fig 21
Fig 22
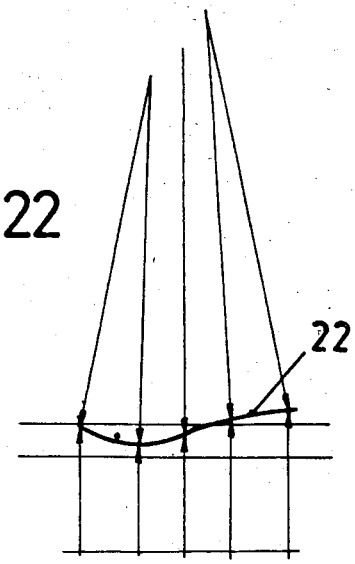

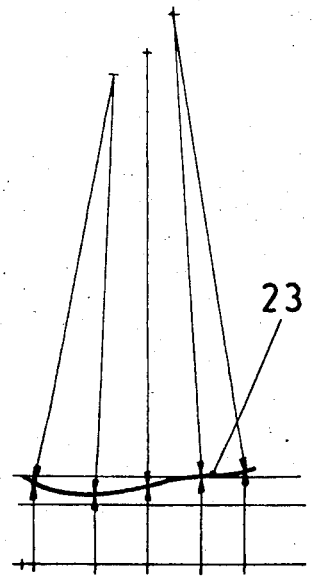
Fig 23
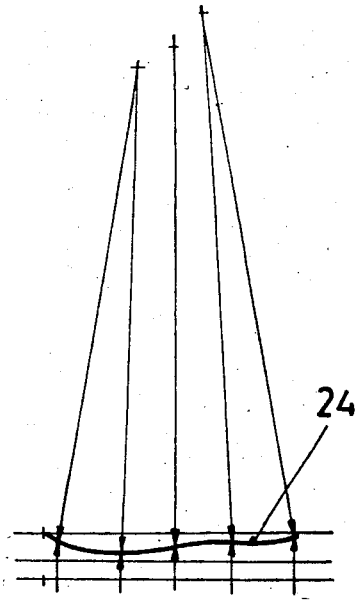
Fig 24
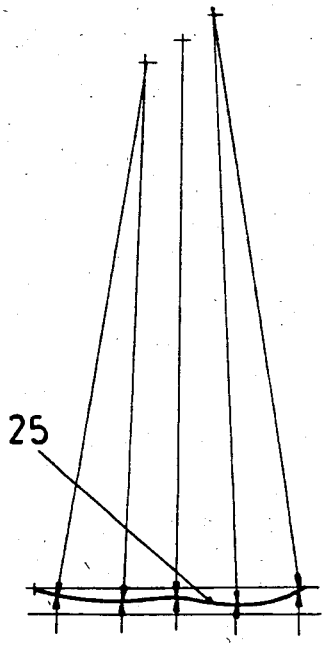
Fig 25
Fig 26
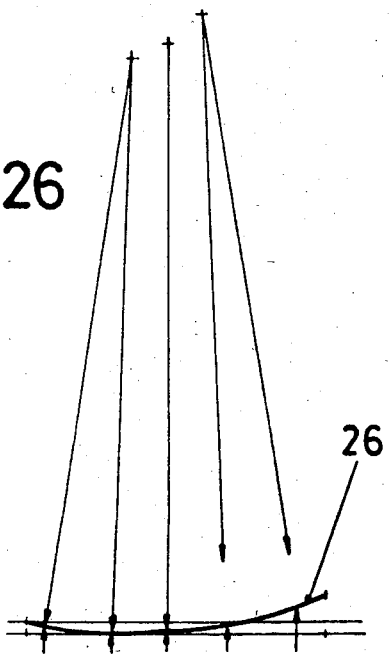

PROCESS FOR THE STANDARDIZATION OF PRIMARY MODELS USED IN THE FABRICATION OF SHOES

In the fabrication of footwear according to the traditional processes which have been used until now, the creation of the first model, called prototype, was very problematic.

Indeed, the creation of the first last matrix (die ?) of the first model is formed by the model maker and is executed entirely by hand, according to the fashion of each moment and according to the type of foot wear to be manufactured.

From that phototype (first model) there is later produced the first pair of lasts which must then be subjected to a series of operations as the pattern must be adjusted, the sole molded and duly reinforced in its posterior two thirds, for the fitting, in the end, of the heel.

That process had to be executed, in Spain, six to seven thousand times a year by the various last makers, as it was possible to execute last prototypes which were exactly equal, when said lasts were executed entirely by hand.

Then it must be indicated that the foot wear manufacturer, once he gets that first pair of lasts, is under obligation to turn to the sole manufacturer, for the latter to adapt one of his soles to the new lasts and then there always arises a problem which can easily be perceived, it being that since the execution of the last by hand results in that from the two or three hundred types of soles already made, the rule is that none of them is suitable enough, this requiring a new adjustment.

But the problems of the foot wear manufacturing does not end there, since once he has obtained the first pair of lasts with their corresponding sole and the assembling of the model already completed, the manufacturer must turn to the industrial heel producer in search of some heels which fit that complex, heels which in the certain existence of one of the largest line of samples, make it possible for the manufacturer always to choose heels corresponding to the fashion of the moment, but if that (fashion) requirement usually is met, we find once more that those heels already chosen for their esthetically fashionable appearance, usually are not accepted because they do not fit with respect to the degrees of inclination and to the axis height necessary as a function of the prepared model unit, forcing the foot wear manufacturer to execute a new coupling and, of course, a new matrix with the obvious increase in costs.

Once the manufacturer has solved all of those problems, with the loss of time they bring about and with the high costs they represent, he moves on to the fabrication phase, during which production becomes complicated because of the numerous specific shoe sizes, giving as a result complaints on the part of the foot wear manufacturer, which complaints the producers of soles are in the impossibility to solve considering the extremely high cost which the fabrication of matrices for each size and variation of each model would represent, complaints which also reach the heel producer as a result of the displacement of the heels, when in reality an analysis of that problem immediately indicates that same do not arise in one specific field or in another but that they inherently are due to a total lack of standardization in the obtainment of the prototype, the process which is here advocated overcoming all of those problems.

In order better to understand the nature of the invention, in the attached drawing we are representing (as an example and illustration only and in no limitative way) one preferred form of execution, at the industrial scale, to which we are referring in our description, in that drawing.

Figure 3:
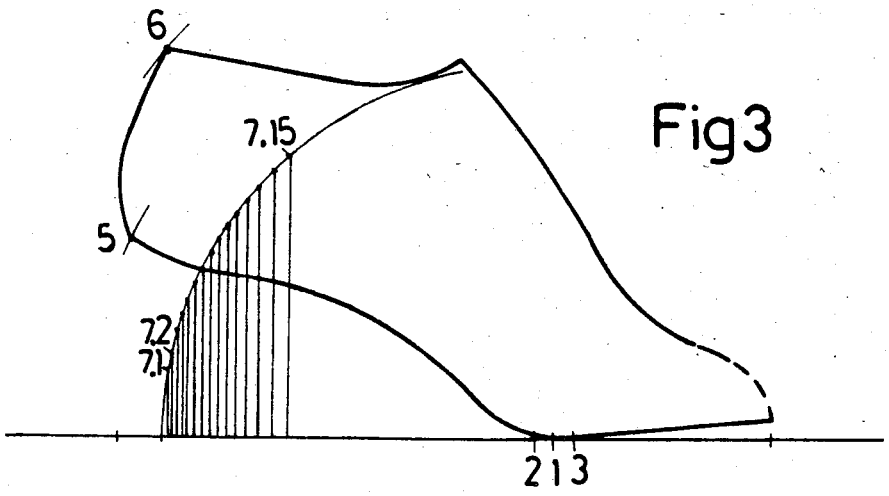

FIG. 3 also is a profile view in which there has been traced an arc which comprises the fifteen different heel heights in a progressive variation of 5 mm to five mm.

Figure 4:
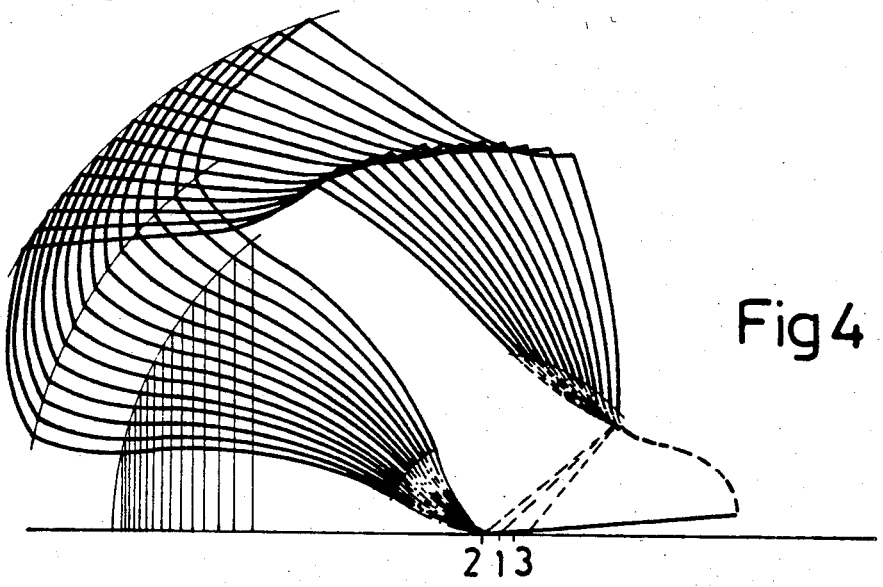

FIG. 4 corresponds to the general arrangement of heights.

Figure 5:
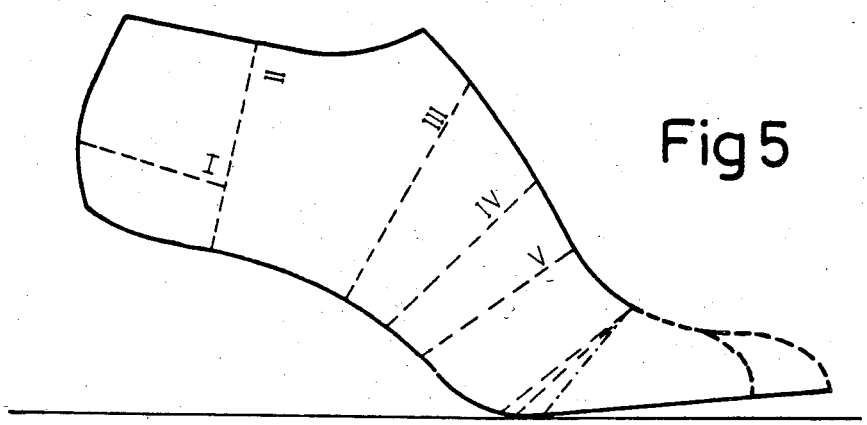

FIG. 5 shows the general situation of the sections.

Figure 6:
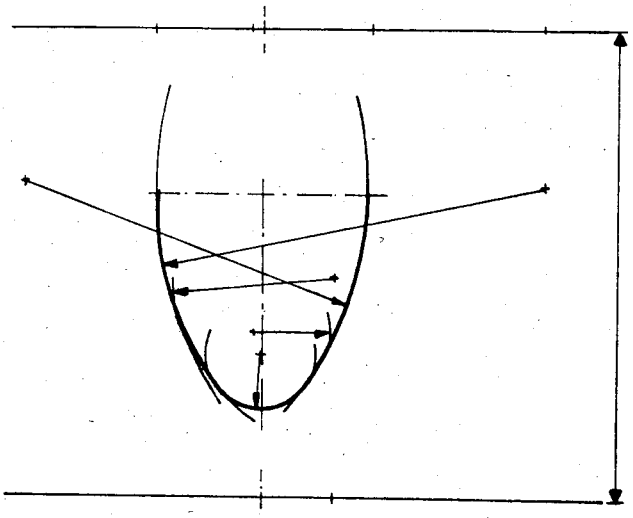

FIG. 6 and FIG. 6 bis respectively correspond to Section I and to the pattern thus obtained.

Figure 7:
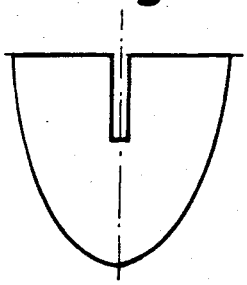
Figure 7:
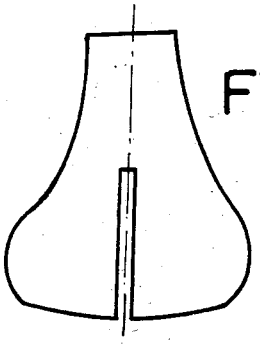
Figure 7:
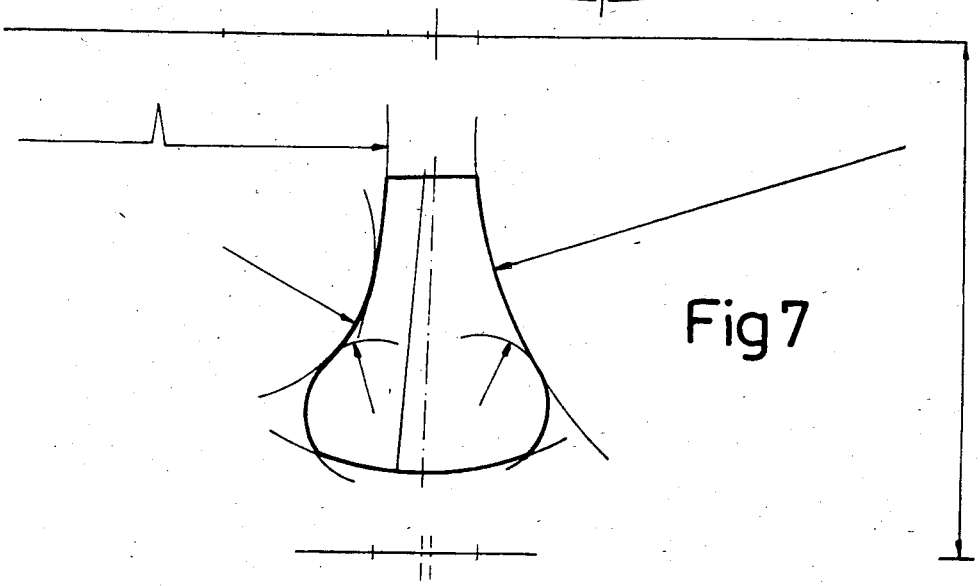
Figure 8:
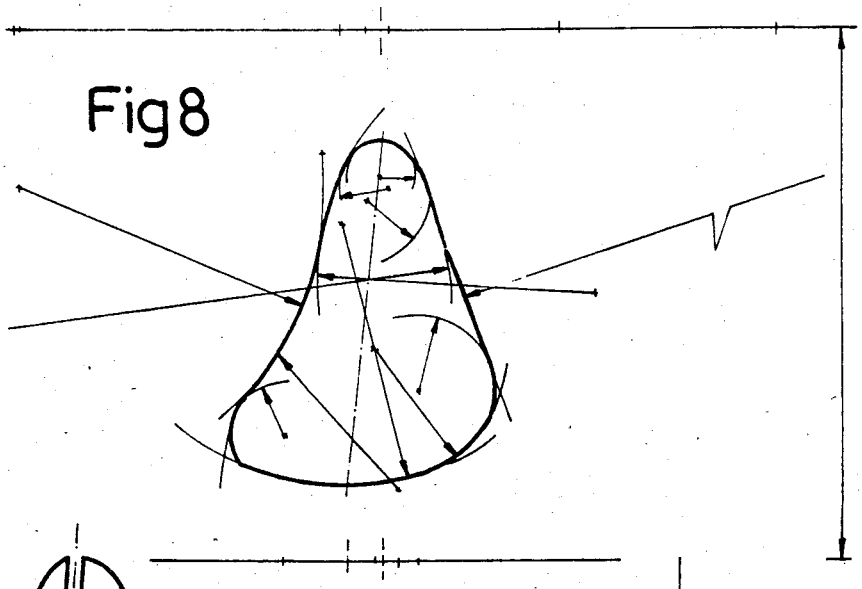
Figure 9:
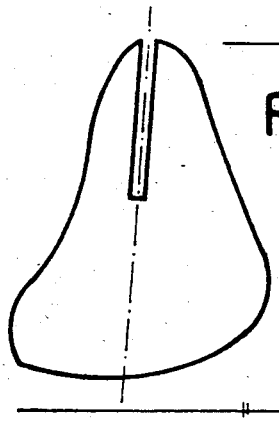
Figure 9:
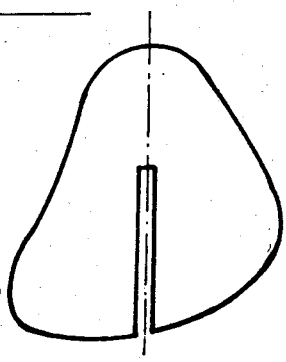
Figure 9:
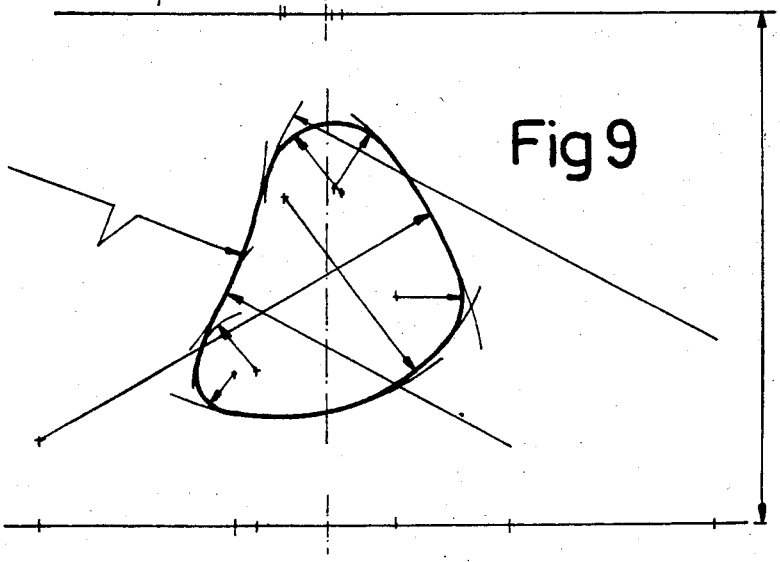
Figure 10:
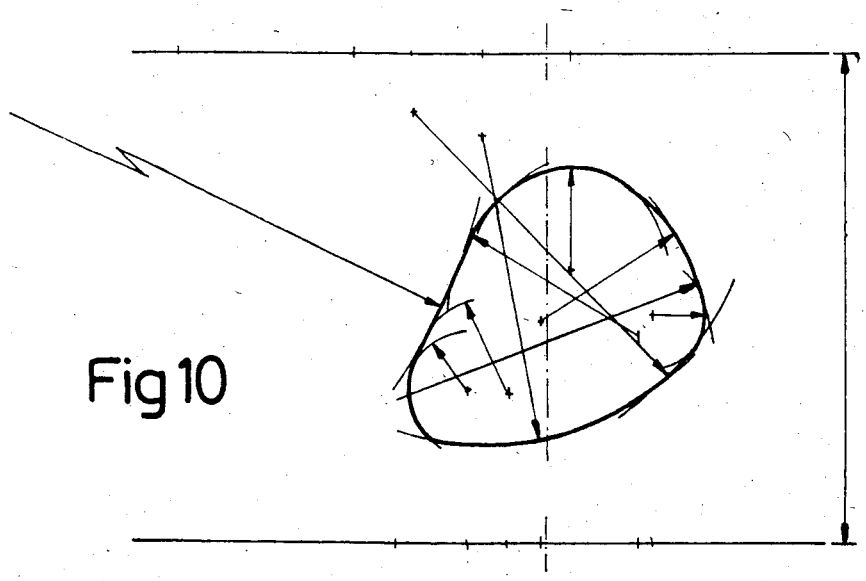

FIG. 7 and FIG. 7 bis to FIGS. 10 and 10 bis correspond to Figures such as the two above-indicated ones, respectively in sections II, III, IV and V.

Figure 11:
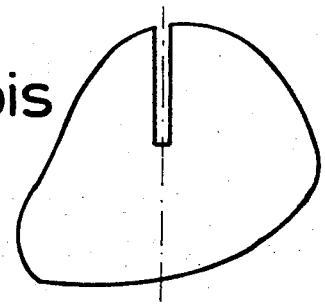
Figure 11:
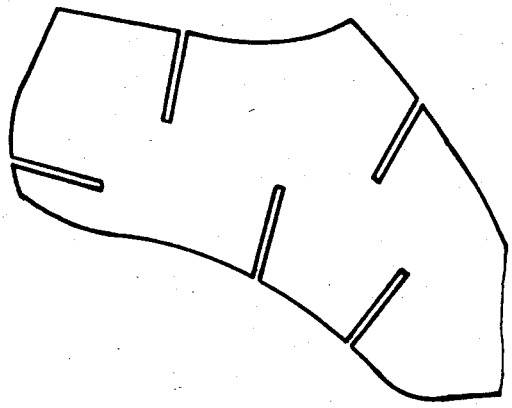

FIG. 11 represents the shape on which, in the manner of a resistant skeleton, there are mounted the patterns which appear in FIGS. 6 to 10 bis.

Figure 12:
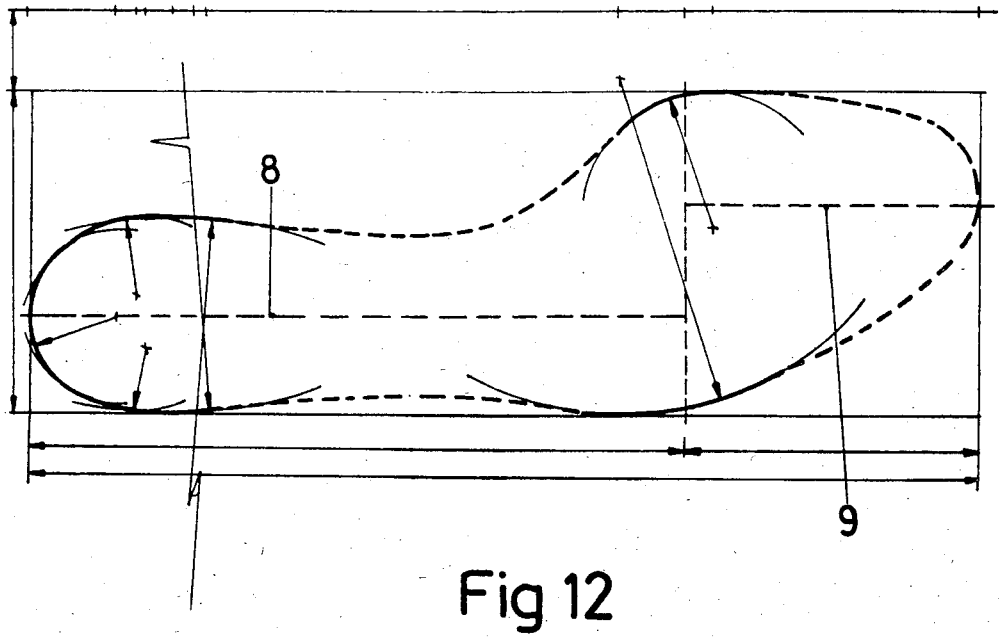

FIG. 12 corresponds to a view of the typical sole.

Figure 13:
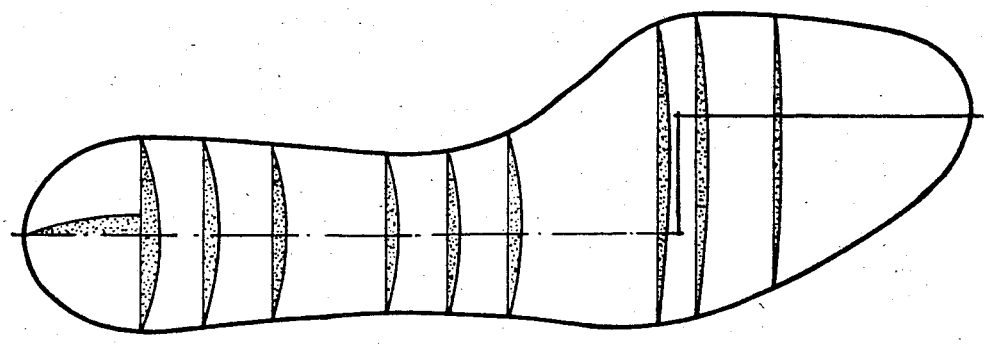

FIG. 13 corresponds to the sections of the typical sole.

Figure 14:
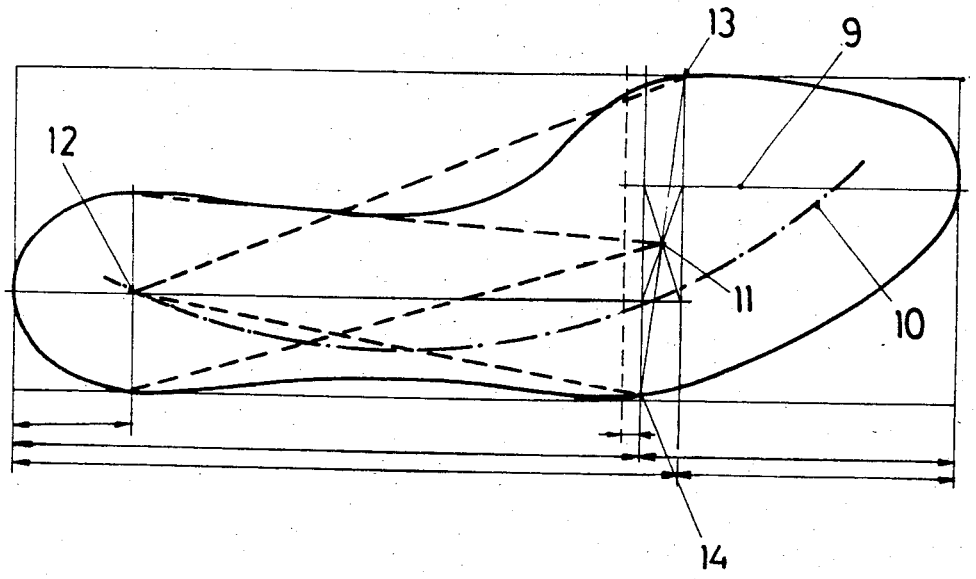

FIG. 14 shows the internal support of the typical sole, with its dynamic load line (10) and its triangulations.

Figure 15:
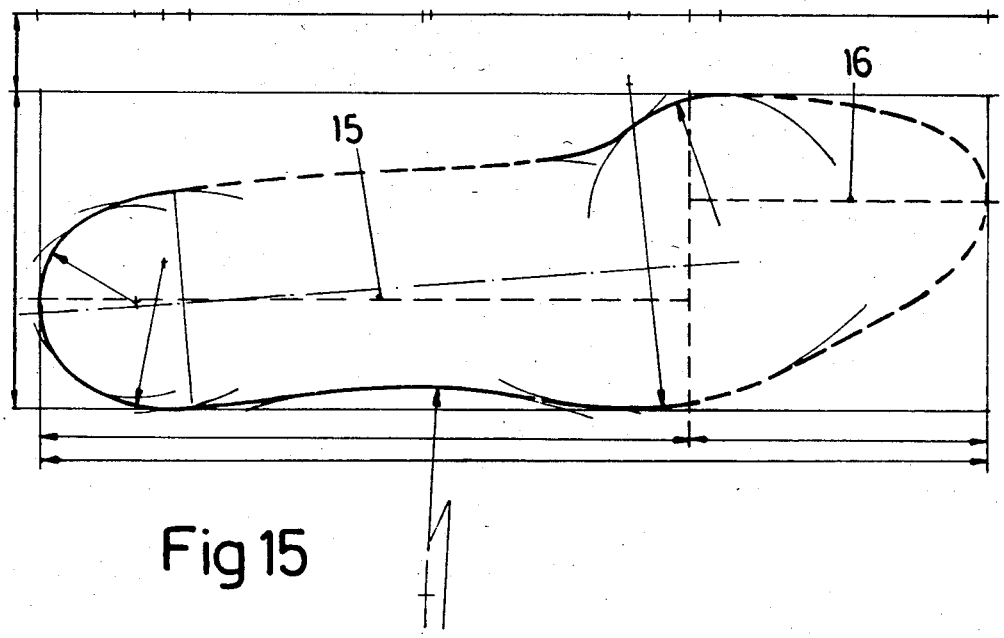

FIG. 15 corresponds to the anatomic type sole.

Figure 16:
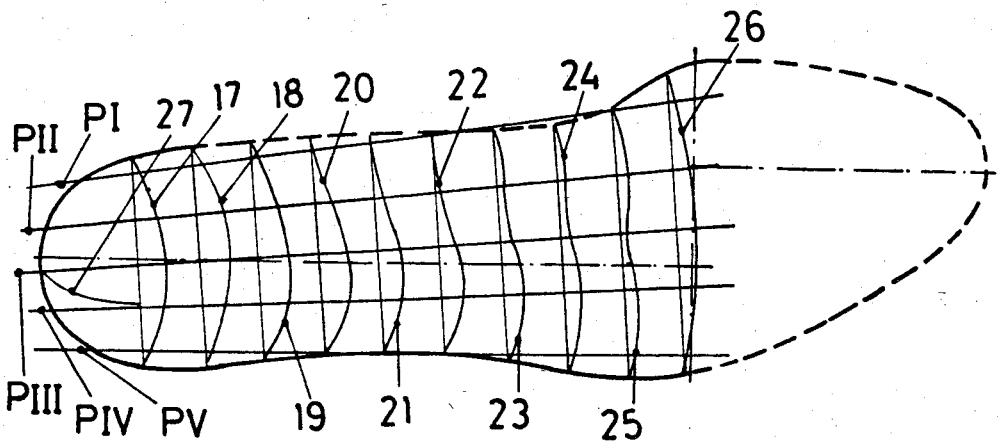
Figure 17:
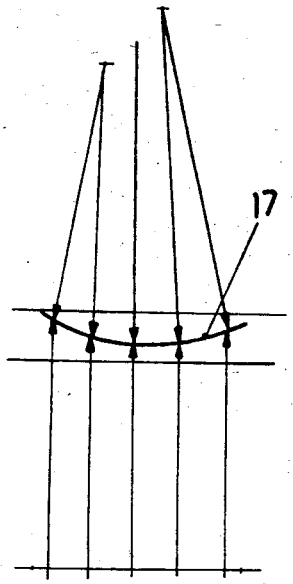
Figure 18:
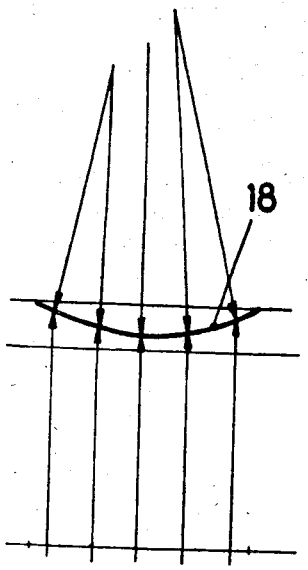
Figure 27:
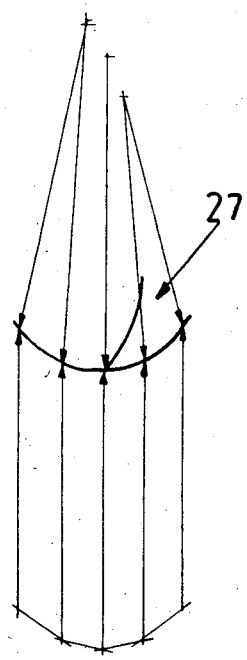
Figure 28:
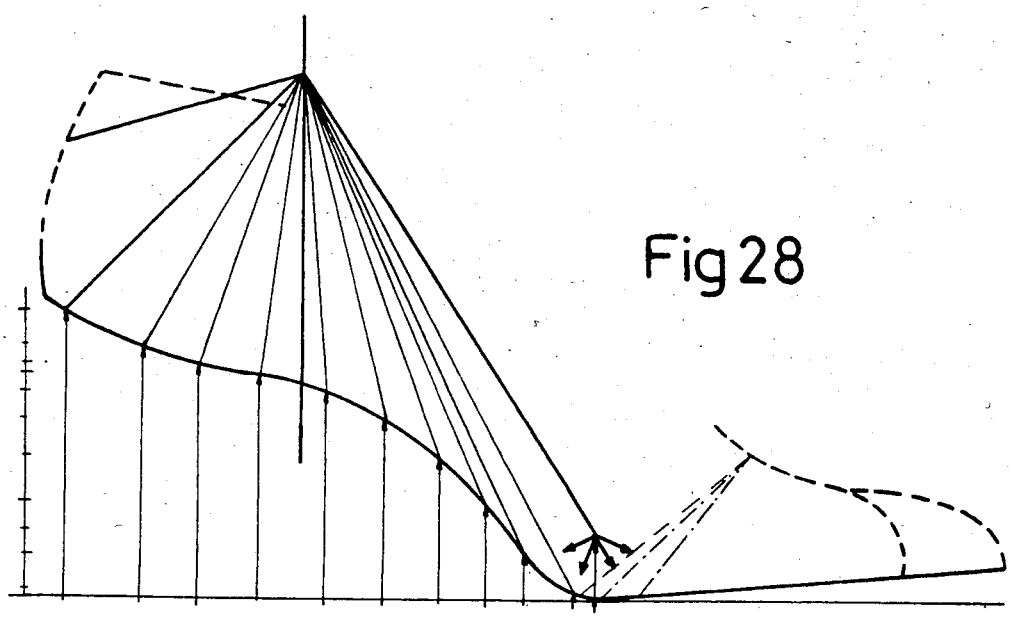
Figure 29:
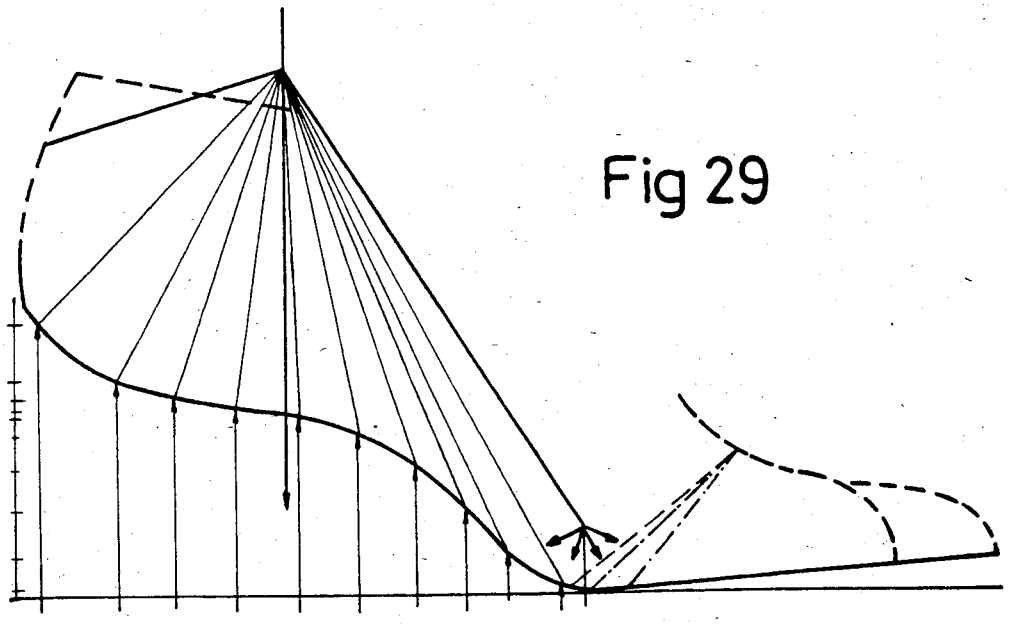
Figure 30:
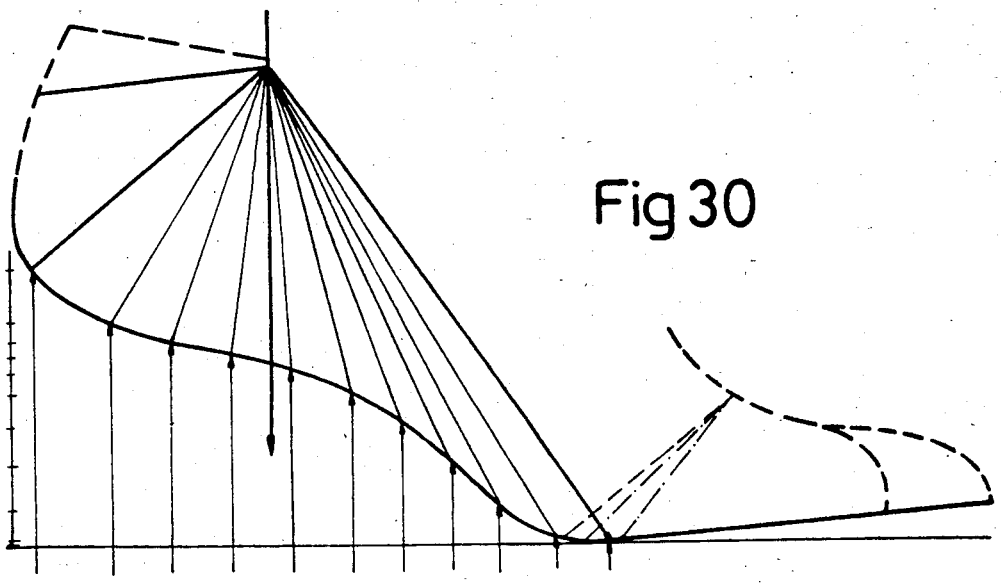
Figure 31:
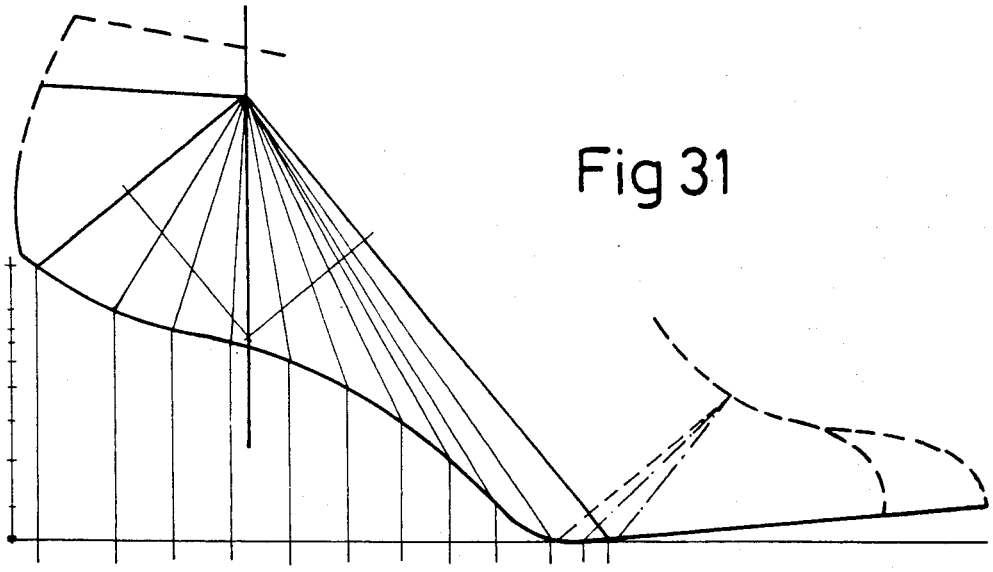
Figure 32:
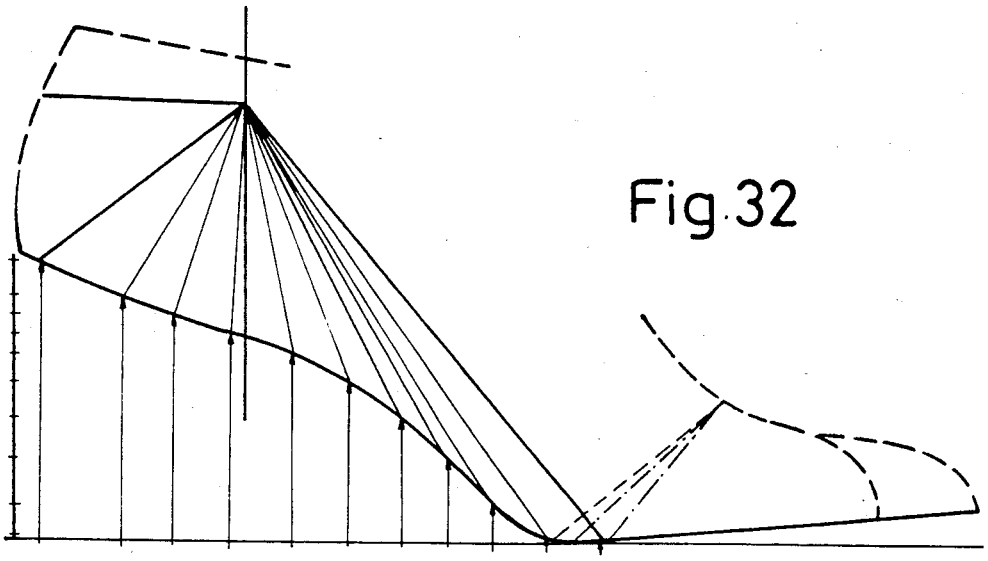

FIG. 16 shows the contact squaring with the load of the typical anatomical sole.

FIGS. 17 to 27 show the indicated sections with the reference numbers boing the same in 17 to 27 as in FIG. 16.

FIGS. 28, 29, 30, 31 and 32 correspond to the longitudinal points indicated by references I, II, III, IV and V in FIG. 16.

Figure 33:
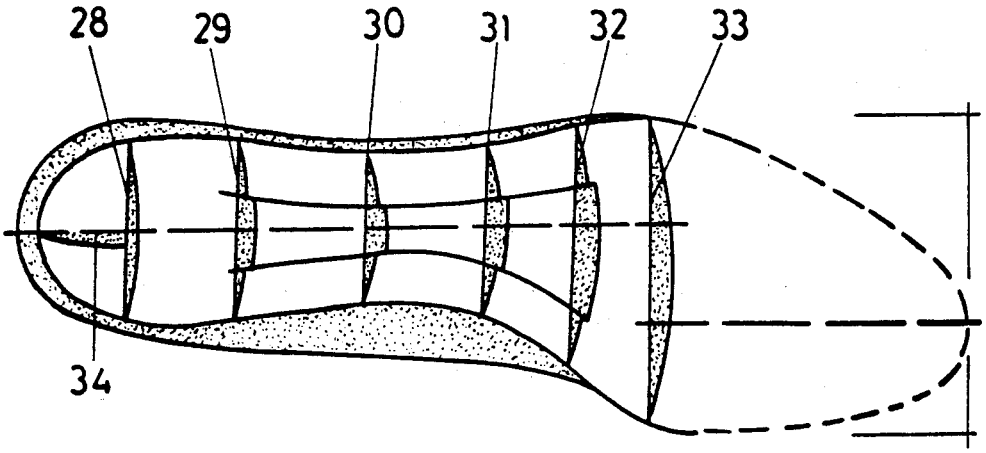

FIG. 33 shows the lower part of the typical anatomical sole.

Figure 34:
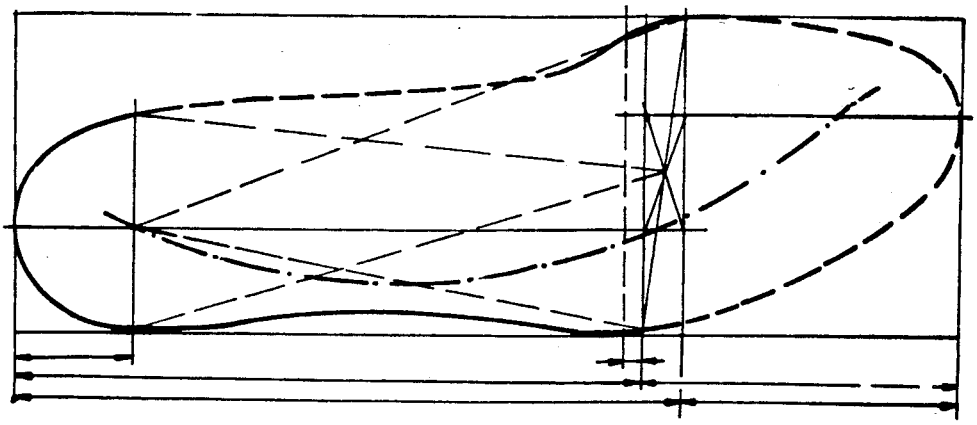

FIG. 34 corresponds to the support of the typical anatomical sole, with its triangulations.

The process which constitutes the object of the present invention begins with a careful study of the human feet, since such a study is going to make it possible for us to determine the types of the different feet, with their relative percentages.

From that study there has been found that the five main types of feet are:

The NORMAL foot
The outward bent foot
The wide foot
The FLAT foot
The HOLLOW (highly arched ?) foot From that investigation there has been found that the percentage of normal feet is approximately 55%; while that of the WIDE foot and of the OUTWARD BENT foot, is 15% and for the FLAT foot and HOLLOW (highly arched) foot it is 5% for each one of them, the remaining 5% comprising an infinity of types.

Those results are entered into a few squares, according to the graph given below, in which in the vertical direction there are five squares placed in a manner such that the central one corresponds to the normal foot, which has on each upper and lower sides, respectively, the OUTWARD BENT foot and the WIDE foot while the FLAT foot and the HIGHLY ARCHED foot are placed at the extremities.

The different perimeter measurements for a given length are entered into eight squares in the horizontal direction for the NORMAL FOOT; while there are seven squares for the WIDE FOOT and the OUTWARD BENT foot and five squares for the FLAT FOOT and the HIGHLY ARCHED foot. All of those squares can later be inscribed inside an ellipse, and for that reason the diagram has been called the ellipse.

All of those data were obtained following a very extensive taking of basic feet measurements, such as their length, the perimeter of the toes, the low instep, the high instep and the high heel instep, as well as the length from the malleolus up to the head of the femur, the total height of the person as well as the weight of same. According to all of those (measurements, we shall hereafter refer to the central square which represents the NORMAL foot type which embraces 55% of the human race. (of the population ?)

According to the above, we can project the length measurements in five sizes falling between the minimum and maximum steps, expressed in centimeters, projected sizes which are:

1. 24 cm for the women footwear in fifteen different heights.
2. 27 cm for men footwear in fifteen different heights
3. 20 cm for the boys and girls shoes of the second series, in six different heights.
4. 16 cm for the boys and girls shoes of the first series in five different heights.
5. 12 cm for first footwear item and for babies, in four different heights.

Figure 1:
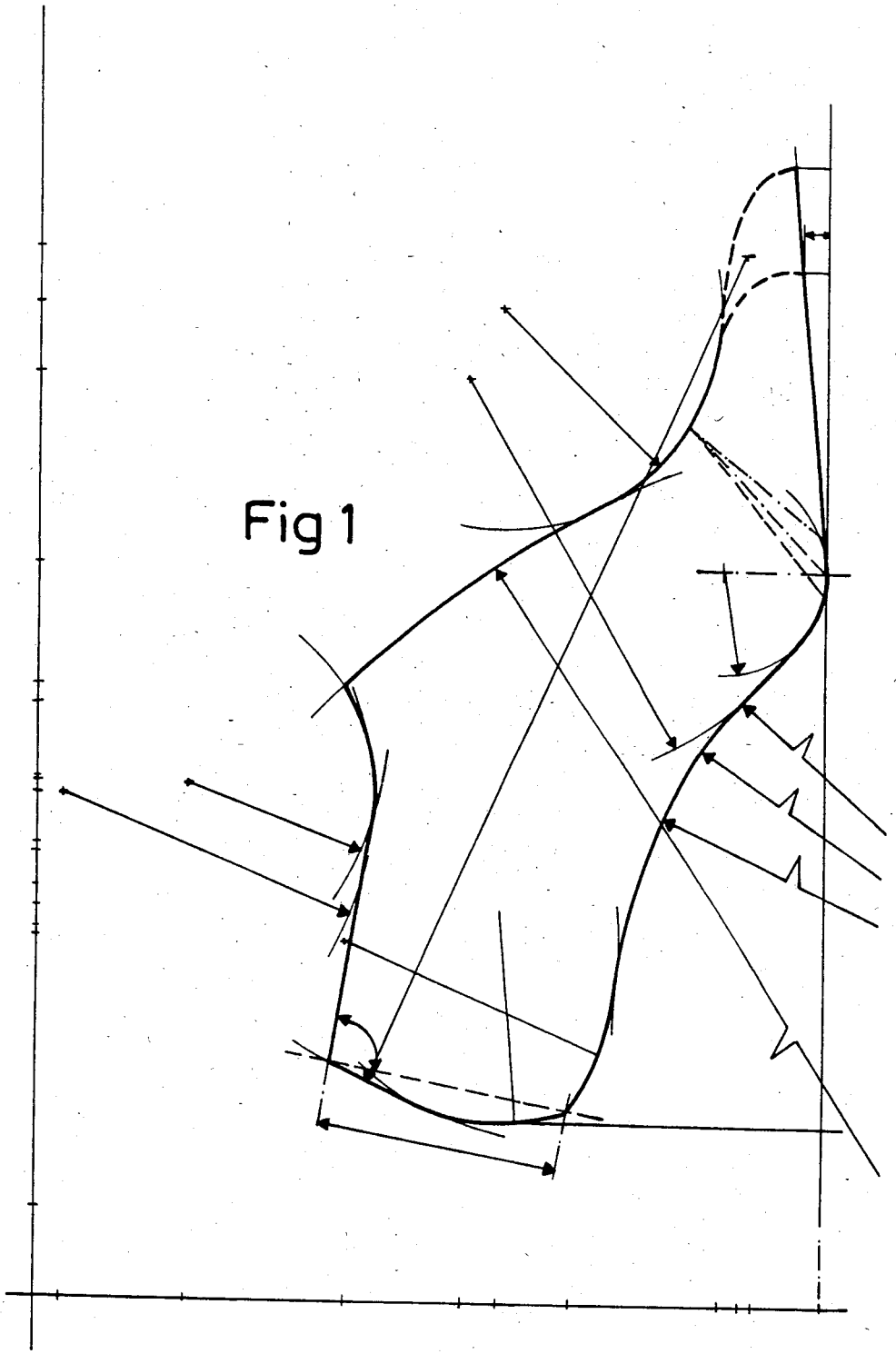
FIG. 1 is a longitudinal profile view.

Now, taking the women footwear as an example of the development of the process which constitutes the present invention, and with a 24 cm foot length, there is traced with the series of values directly obtained from said foot, its longitudinal profile, as represented in FIG. 1 of the attached drawing.

Once we have that longitudinal profile, we find that the tarsus and the metatarsus joined by Chopar articulation, are the two posterior thirds of supporting thirds, while the remaining third is joined by the metatarso-phalangial articulation, determining the plantar zone. In the remainder of the lengths, the progressions in the higher and in the lower directions are mathematical proportionality constants of the simple rule of three.

Figure 2:
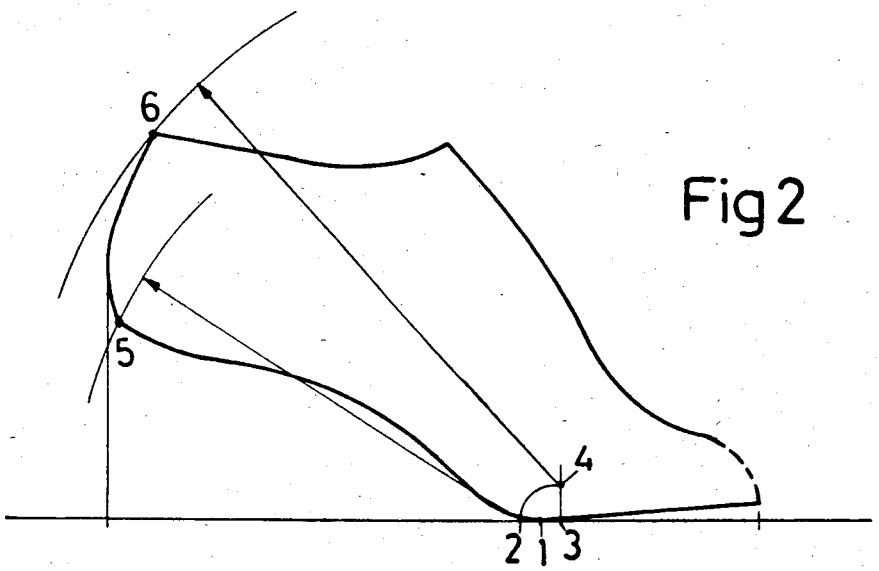
FIG. 2 is also a longitudinal profile view but in which there is indicated the tracing of the arcs which run through points (5 and 6), taking at the center point 4.

That central point of the metatarso-phalangial articulation we shall call point of "O QUOTE" which, according to the above, is found at a distance of two thirds from the posterior zone of the longitudinal profile and of one third from the tip, as it may be seen in FIG. 2, in which said "O QUOTE" point is indicated with reference mark 1.

With the center in said point 1, we take 5 mm on each side, to obtain in that way the point indicated with reference mark 2 and which corresponds with the point of HEIGHT, and the point indicated with reference mark 3 which is that of the footstep (PISADA) with center in point 3 or FOOTSTEP, and the radius the distance between points 2 and 3 there is obtained reference point 4 as it may be seen in the above FIG. 2.

All of the conventional heights for heels are found between 25 mm and 95 mm, this thus giving 15 different heights with 5 mm intervals.

For that reason, with the center in 2, we trace the arc having a 2–5 radius, while with center 4, we trace the arc having the 4–6 radius, see FIG. 2 for that profile represented in FIG. 2, the theoretical base of the heel is a square the side of which is 6 mm so that the projection will reach 3 cm from the posterior extreme point of the floor line, that is to say to the total length which is eight into 24 cm.

At that point which is set at 3 cm of the posterior end of the floor line there is given reference number 7 in FIG. 3 of the attached diagrams so that from said point 2 we trace the arc 2–7.

On that arc there must be encountered the axes of the different heels and in order to define them, it will be sufficient to take the values of same from the floor line.

Those values progress in 5 mm increments, starting with 25 mm, until they reach 95 mm. In that manner, there is obtained FIG. 3 and with it, a series of points 7, 7.1, 7.2 . . . 7.15 which will be those through which there must be traced the different longitudinal profiles of the last, all of it in fanning rotation as represented in FIG. 4 of the attached drawing.

Once the longitudinal profile has been calculated, there are then traced the frontal sections which, according to the process used, correspond to five sections which can be appreciated in FIG. 5.

Those sections are:

SECTION I: that section is that of the calcaneum capacity (volume ?)

SECTION II: is the section of the ankle

SECTION III: that section is that of the high instep

SECTION IV: that section is that of the middle (instep)

SECTION V: that section is that of the low instep

The sections thus obtained are represented in FIGS. 6, 7, 8, 9 and 10, respectively.

With those sections, there are obtained soles represented in FIGS. 6 bis, 7 bis, 8 bis, 9 bis and 10 bis, all of them fitted with a groove to be placed in the manner of a skeleton on reciprocal grooves of the longitudinal profile, see FIG. 11, the hollow points being later filled in order to obtain, in the end, the model with respect to its colophon profile, and with respect to those profiles it must be indicated that the upper profile is of vital importance and that it must be trusted with the greatest respect, because if the lower profile determines the longitudinal profile of the human foot, the upper profile does not determine anything practical in the final result of the shoe, but it is certainly fundamental and basic as a point of support for mechanical fabrication and later to eliminate the total lack of control which exists in the present world of footwear at the same time as it must serve as a basis for the development of new research in the field of footwear machinery and the like.

Between the lower and upper profiles, there must be respected the load and support triangulations which are given to us from the malleolus or external ankle to the fifth metatarsal and Achilles tendon, or from the internal malleolus or ankle to the first metatarsal and Achilles tendon. The posterior profile is supplied to us by the calcaneum, raising it from the lower profile to the calcaneum-Achilles tendon junction, the remainder being as union to the lower profile.

In order to establish the projection and the execution of the profiles of the boot-type of footwear which cover and extend beyond the tibia-ankle bone articulation, there must be taken into account the narrowing (retreat) of the Achylles tendon as well as the longitudinal dilatation of the instep or antera-superior zones of the tibia-ankle bone articulation and the antero-superior zones of Chopar articulation, which actually are neither taken into account nor respected by any one in the footwear fabrication world.

That being seen, we are going to pass to the description of what is the process for the obtaining of the soles.

To that end, we are going to project two distinct types, the first sole as presently traditionally manufactured; while the second sole will be projected according to anatomy or total coupling of a human foot to said sole.

With respect to the first case, we shall only project (plan ?) the longitudinal axis of the two posterior thirds, an axis which we shall indicate by reference number 8 in FIG. 12 of the attached drawing.

Said longitudinal axis 8 extends as far as "O QUOTA" or to the center of the metatarso-phalangial articulation, setting as a boundary in the transverse direction from the first metatarsal to the fifth metatarsal for later, and from the point which we set between the heads of the first and second metatarsal and in a direction parallel to the preceding axis, extending in the remaining or plantar third the axis indicated by reference number 9 in FIG. 12 of the attached drawing.

In a posterior phase, there are executed the curve sections, the load and external support triangulation.

In that direction we execute the triangulation of the foot support which is determined by joining the central point of the calcaneum 12, see FIG. 14, to the load of the first and fifth metatarsals, indicated by references 13 and 14, respectively.

The dynamic load line is developed from the center of the calcaneum 12 to its external and anterior part, running through articulations four and five, to end (die) at the first phalange-second phalange articulation of the big toe. That dynamic load line is indicated by reference 10 in FIG. 14 of the attached drawing.

In the posterior direction we extend the axis of the two back thirds, 8, by a 5 mm measurement to its footstep and the anterior axis 9 we extend by 5 mm backwards to the point of rising, we cross them (the two axes) with a cross and in their center 11 we cut divide) toward the rear part and concretely toward the lateral (sides) of the center of the calcaneum 12 which are given for a perfect balance of the shoe.

This sole obtained in that manner and represented in FIG. 14 practically corresponds to the track or footprint which a wet human foot marks on a flat surface.

With those same operations again using as in the preceding cases the simple rule of three, there are corrected the remaining sizes.

The second sole, we are projecting it in its anatomical sense and with total coupling respective to the sole of a human foot, that is to say as it occurs when stepping on sand or on a soft carpet.

To that end, we are projecting the longitudinal axis of the rear two thirds 15, and the transverse one through their "O QUOTA", between the first and fifth metatarsal-phalangial articulations through their external parts, continuing from the ")QUOTA" and from the central point of the first and second metatarsals in a direction parallel as far as their most anterior part, according to the axis indicated by reference 16 in FIG. 15 of the attached drawing.

In a later phase, there are projected the sections of the transverse curves, which deserve a deep study since that part of the foot, because it is that of support or of contact with the shoe, transmits the entire human weight at the same time as it must maintain in perfect balance the entire bone armature and must facilitate the return of the blood flow circulation.

For that we see first of all in FIG. 16 how theere are indicated the longitudinal bridges indicated with references P-I, P-II, P-III, P-IV and P-V those bridges are represented in FIGS. 28, 29, 30, 31 and 32 of the attached drawing.

It may be appreciated how the tarsus in its most posterior part starts a more pronounced curve to go softening in its center and as far as the Chopar articulation and from the latter to extend toward its anterior part in two very distinct characteristics, one exterior one through which there runs the dynamic load line and the other one interior, through which there run the main flexor tendons of the foot, the long and the short flexors which are the internal point of the perfect balance and of the flexions of the human foot.

Taking the above into account, there are now projected the two posterior thirds, that is to say the tarsus and metatarsus, in ten transverse curves and one longitudinal one, the ten transverse curves being indicated in FIG. 16 with reference numbers 17, 18, 19, 20, 21, 22, 23, 24, 25 and 26; while the longitudinal line is placed in the most posterior part and is indicated by reference 27.

All of those transverse sections have been respectively represented in FIGS. (by ?) 17, 18, 19, 20, 21, 22, 23, 24, 25, 26 and 27.

For the lower part of the shoe or the part which is in contact with the ground, we go back to projecting (design, draft ?) a few transverse curves off which six are level with the ground and are indicated by 28, 29, 30, 31 and 32 in FIG. 33 of the attached drawing, there existing in addition a longitudinal section in the most posterior part, indicated by reference number 34 in that Figure.

The drafting of the triangulations of support or sustentation of the foot or of the balance of the shoe, as well as the dynamic load is obtained in the same manner as in the preceding case represented in FIG. 14, there being now represented in FIG. 34 the solution corresponding to the sole of the anatomical type in which there can be perfectly tested how the triangulations remain inside said sole.

As everything described heretofore, there is obtained a shoe which perfectly fits the foot at the same time as there is maintained the purity of the external lines and there are open new paths for the creation of new models.

The nature of the present invention having been sufficiently described as well as its industrial execution, there only remains to add that as a whole and in its constituting parts it is possible to introduce changes in shape, material and arrangement, without for as much leaving the scope of the present invention, as long as such alterations do not take away its fundamental principles.

The Applicant, under the protection of International Agreements on Industrial Property, reserves for himself the right to extend the present Application to foreign countries, if possible, claiming the same priority as that of the present Application.

The Applicant also reserves for himself the right to request the suitable Certificates of Addition in the form indicated by the Law, upon introducing into the present invention improvements derived from same.

I claim:

1. A process for making original primary models for the fabrication of shoes, the process comprising the steps of:

a. forming a longitudinal profile of a last relative to a theoretical ground line, the ground line length of said last corresponding to the actual length of said profile;

b. dividing said profile into three equal parts, forming two posterior thirds and one anterior third;

c. establishing a basic longitudinal support for the part of the foot in the two posterior thirds, said support especially affecting the tarsus and metatarsus zone;

d. establishing a basic support for the plantar or flexion part of the foot in the front third;

e. forming and assembling templates corresponding to the supports established in steps c and d; and f. filling voids between said templates to form said assembly into a solid basic primary model.

2. The process of claim 1 wherein a common point at the intersection between the two posterior thirds and the plantar third is a "zero" point used to obtain two separate points which are on opposite sides of the foot and which are reciprocally equidistant away from the "zero" point; a point which is a preferred distance of approximately 5 millimeters away from one of said two points being used as a reference to provide elevation measurements; the other of said two points being used as a reference to provide a foot step point, the two points being used together as a start of the elevation of the anterior zone of the foot.

3. The process of claim 2 wherein a plurality of heel heights are taken in a range from a height of twenty five millimeters to ninety five millimeters, in five millimeter variations between any two consecutive heels and the added steps of:

processing those heel heights to generate different values relative to said ground line and to lines which are perpendicular to the ground line;

generating contour lines responsive to those generated values and taking as the point of rotation the metatarsal-phalangial point of articulation to give a longitudinal profile for each of the different levels of the heel heights; and forming last templates following a clockwise rotation motion of the generated contour lines whereby a fan of the various longitudinal profiles is generated while maintaining unchanged the two posterior thirds of each profile.

4. The process of claim 3 wherein there are fifteen locations along the ground line which correspond to fifteen values of the different heel heights, and the added steps of:

taking measurements from the posterior end of said ground line corresponding to one-eighth of its value;

tracing an arc from a specific point, the arc forming a boundry inside which must be inscribed the different values of the heel heights, so that a template corresponding to each elevation level of a heel is cut within said arc; and forming the respective longitudinal profile of the last with said specific point on each of said profiles.

5. The process of claim 4 and the added steps of:

setting the location of both inferior and superior extreme points of a posterior arc of a plurality longitudinal profiles; and tracing two arcs, one of which has as its center the point of elevation, said one arc extending to the extreme inferior point, the other of said two arcs having as its center the vertical of a footstep point in the metatarso-phalangial articulation, and extending as far as an upper point at the posterior arc of the longitudinal profile of the last.

6. The process of claim 1 and the added steps of:

tracing the frontal sections of the longitudinal profile of the last, there being five sections which respectively correspond to: the cross-section volume at a calcaneum; the cross-section volume at an ankle; the cross-section volume at a high instep; the cross-section volume at a middle instep; and the cross-section volume at a low instep;

placing those sections on suitable positions along a longitudinal profile of the last; and forming said sections and said longitudinal lasts into said templates and assembling them into a resistant skeleton the filling of which obtains the general body of the shoe last.

7. The process of claim 1 and the added steps of:

determining contours of a sole, the contours having values which remain inside a rectangle the long side of which corresponds to the total length of the sole; and tracing over the two posterior thirds of said sole a longitudinal axis which runs from the calcaneum to the metatarso-phalangial articulation and over the anterior third, and a plantar axis running from the metatarso-phalangial articulation to the anterior end of the sole.

8. The process of claim 7 and the added steps of:

defining an internal and an external triangulation of a lonitudinal support; the internal triangulation extending from the center of the calcaneum to the first metatarso-phalangial articulation and to the fifth metatarso-phalangial articulation; the external triangulation extending along lines of balance starting at the tip of the footstep, and extending to two points located in a theoretical plane, running through the center of the calcaneum, said external triangulation being perpendicular to the long sides of the rectangle inside which the sole is inscribed; forming a dynamic load line extending from the center point of the calcaneum, and running between the fourth and fifth metataso-phalangial articulations to end in the first phalange-second phalange articulation of the big toe, said curve being traced from an external point with an external radius of approximately seventeen centimeters.

9. The process of claim 7 and the added steps of:

determining curves defining the values of an anatomical sole by forming a pattern of a footprint in a particulate material for obtaining a wider footprint which picks up the external triangulation of the inverted load, the internal triangulation, and a longitudinal support.

10. The process of claim 9 and the added steps of:

determining different transverse arches of the foot;

forming curves at ten transverse sections along five bridges which are longitudinally distributed over the sole; and forming and assembling said templates into a network of a resistant frame which completes the shapes of said sole in an anatomical adaptation thereof.

11. The process of claim 1 and the added steps of:

tracing the lower part of the sole in at least six transverse sections, the four central transverse sections extending downwardly following a projecting part.

* * * * *